US008105014B2

(12) United States Patent
Tholen et al.

(10) Patent No.: US 8,105,014 B2
(45) Date of Patent: Jan. 31, 2012

(54) GAS TURBINE ENGINE ARTICLE HAVING COLUMNAR MICROSTRUCTURE

(75) Inventors: Susan M. Tholen, Kennebunk, ME (US); Philip R. Belanger, Acton, ME (US); Christopher W. Strock, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 541 days.

(21) Appl. No.: 12/413,885

(22) Filed: Mar. 30, 2009

(65) Prior Publication Data

US 2010/0247291 A1 Sep. 30, 2010

(51) Int. Cl.
*F01D 5/20* (2006.01)

(52) U.S. Cl. ..... 415/116

(58) Field of Classification Search ..... 415/173.1, 415/200, 116; 416/241 R
See application file for complete search history.

(56) References Cited

U.S. PATENT DOCUMENTS

| | | | | |
|---|---|---|---|---|
| 4,069,662 | A | 1/1978 | Redinger, Jr. et al. | |
| 4,422,648 | A | 12/1983 | Eaton et al. | |
| 5,830,586 | A | 11/1998 | Gray et al. | |
| 5,876,860 | A | 3/1999 | Marijnissen et al. | |
| 6,007,880 | A | 12/1999 | Maloney | |
| 6,102,656 | A | 8/2000 | Nissley et al. | |
| 6,187,453 | B1 | 2/2001 | Maloney | |
| 6,224,963 | B1 | 5/2001 | Strangman | |
| 6,551,372 | B1 * | 4/2003 | Ewing et al. | 75/246 |
| 6,703,137 | B2 | 3/2004 | Subramanian | |
| 6,946,208 | B2 | 9/2005 | Subramanian et al. | |
| 7,481,098 | B2 * | 1/2009 | Robertson et al. | 73/104 |
| 7,603,890 | B2 * | 10/2009 | Vetere et al. | 73/104 |
| 2005/0111966 | A1 | 5/2005 | Metheny | |
| 2011/0164963 | A1 * | 7/2011 | Taylor | 415/173.4 |

FOREIGN PATENT DOCUMENTS

| | | |
|---|---|---|
| WO | 9412775 | 6/1994 |
| WO | 2005071228 | 8/2005 |

* cited by examiner

*Primary Examiner* — Gary F. Paumen

(74) *Attorney, Agent, or Firm* — Carlson Gaskey & Olds, P.C.

(57) ABSTRACT

A gas turbine engine article includes a substrate extending between two circumferential sides, a leading edge, a trailing edge, an inner side for resisting hot engine exhaust gases, and an outer side. A gaspath layer is bonded to the inner side of the substrate and includes a metallic alloy having a columnar microstructure.

16 Claims, 3 Drawing Sheets

GAS TURBINE ENGINE ARTICLE HAVING COLUMNAR MICROSTRUCTURE

BACKGROUND OF THE INVENTION

Gas turbine engine components are often exposed to high temperatures. For instance, the turbine section of a gas turbine engine may include blade outer air seals circumferentially surrounding the turbine blades. The blade outer air seals may include a coating to protect from erosion, oxidation, corrosion or the like from hot exhaust gas flowing through the turbine section. In particular, conventional blade outer air seals may include ceramic coatings, metallic coatings, or both.

A drawback of conventional coatings and blade outer air seals in general, is vulnerability to cracking and coating spall. For example, blade outer air seals may include internal cooling passages or back-side impingement cooling to resist the high temperatures of the hot exhaust gases. However, the cooling may produce a considerable thermal gradient through the seals that may cause accelerated seal corrosion and coating/seal cracking to open the cooling passages.

SUMMARY OF THE INVENTION

An example gas turbine engine article includes a substrate extending between two circumferential sides, a leading edge, a trailing edge, an inner side for resisting hot engine exhaust gases, and an outer side. A gaspath layer is bonded to the inner side of the substrate and includes a metallic alloy having a columnar microstructure.

In another aspect, the gas turbine engine article may be a blade outer air seal within a gas turbine engine. The gas turbine may include a compressor section, a combustor that is fluidly connected with the compressor section, and a turbine section downstream from the combustor. The seal may be included within the turbine section.

An example method of processing a gas turbine engine article includes forming a gaspath layer comprising a metallic alloy having a columnar microstructure, and bonding the gaspath layer to an inner side of a substrate that extends between two circumferential sides, a leading edge, a trailing edge, the inner side for resisting hot engine exhaust gases, and an outer side.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
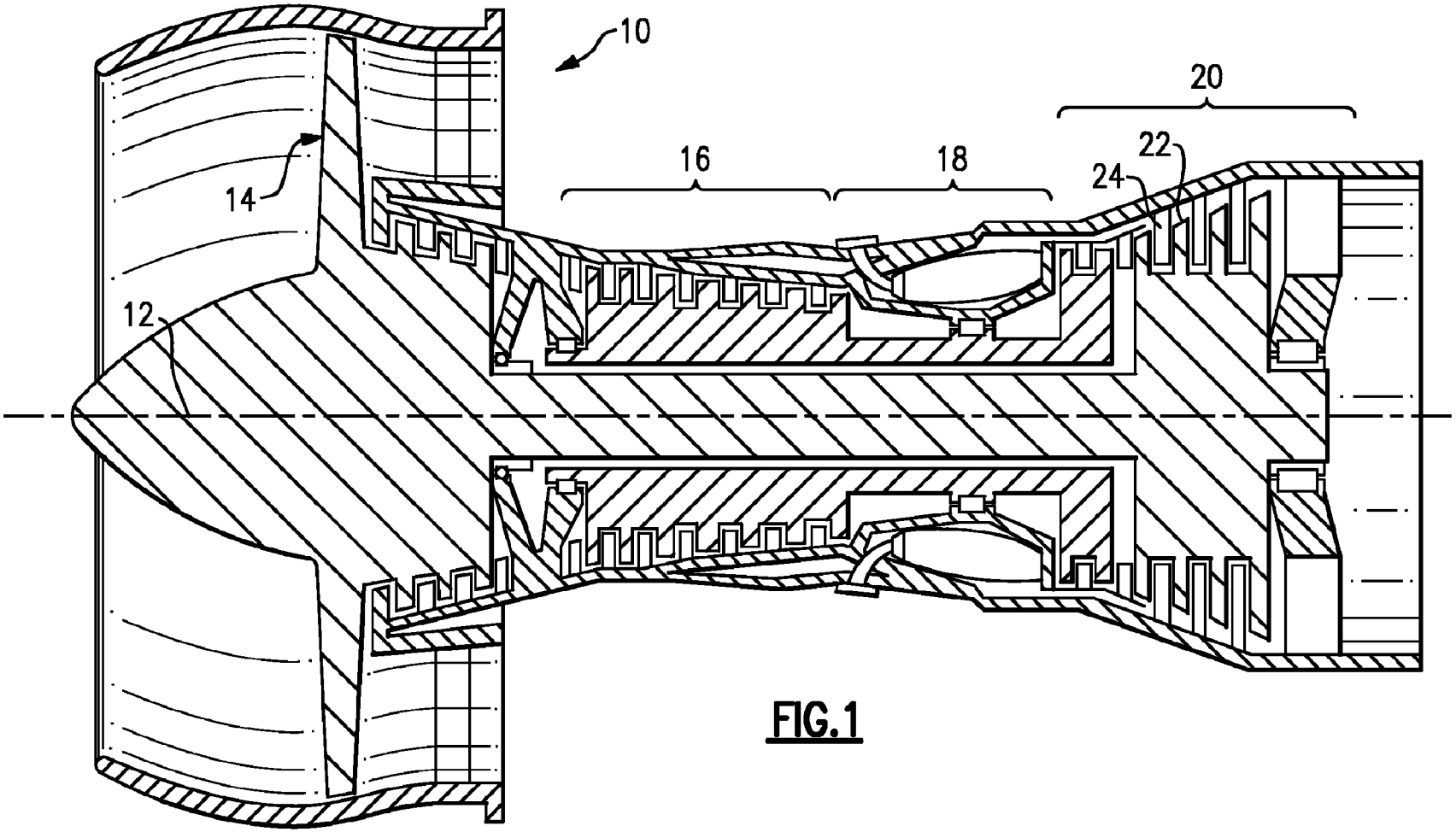
FIG. 1 illustrates an example gas turbine engine.

FIG. 1 illustrates selected portions of an example gas turbine engine 10, such as a gas turbine engine 10 used for propulsion. In this example, the gas turbine engine 10 is circumferentially disposed about an engine centerline 12. The engine 10 may include a fan 14, a compressor section 16, a combustion section 18, and a turbine section 20 that includes rotating turbine blades 22 and static turbine vanes 24. It is to be understood that other types of engines may also benefit from the examples disclosed herein, such as engines that do not include a fan or engines having other types of compressors, combustors, and turbines than shown.

Figure 2:
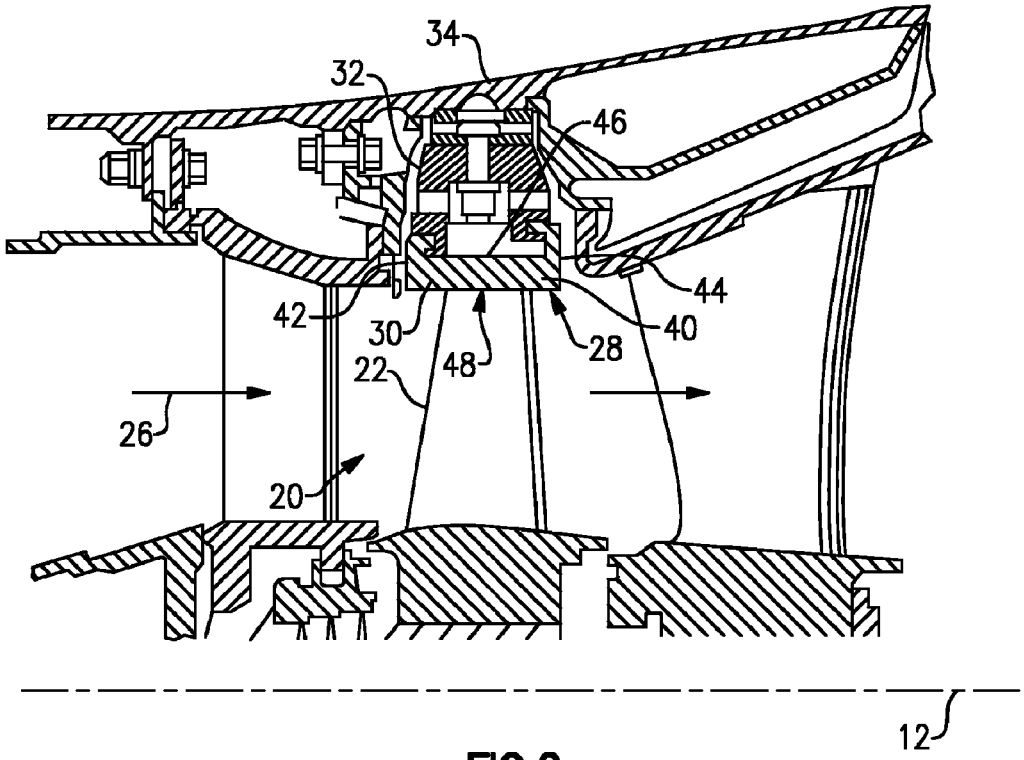
FIG. 2 illustrates a turbine section of the gas turbine engine.

FIG. 2 illustrates selected portions of the turbine section 20. The turbine blades 22 receive a hot gas flow 26 from the combustion section 18 (FIG. 1). The turbine section 20 includes a blade outer air seal system 28 having a plurality of seal members 30, or gas turbine engine articles, that function as an outer wall for the hot gas flow 26 through the turbine section 20. Each seal member 30 is secured to a support 32, which is in turn secured to a case 34 that generally surrounds the turbine section 20. For example, a plurality of the seal members 30 is located circumferentially about the turbine section 20. It is to be understood that the seal member 30 is only one example of an article in the gas turbine engine and that there may be other articles within the gas turbine engine 20 that may benefit from the examples disclosed herein.

The seal member 30 includes two circumferential sides 40 (one shown), a leading edge 42, a trailing edge 44, a radially outer side 46, and a radially inner side 48 that is adjacent to the hot gas flow 26. The term "radial" as used in this disclosure refers to the orientation of a particular side with reference to the engine centerline 12 of the gas turbine engine 20.

Figure 3:
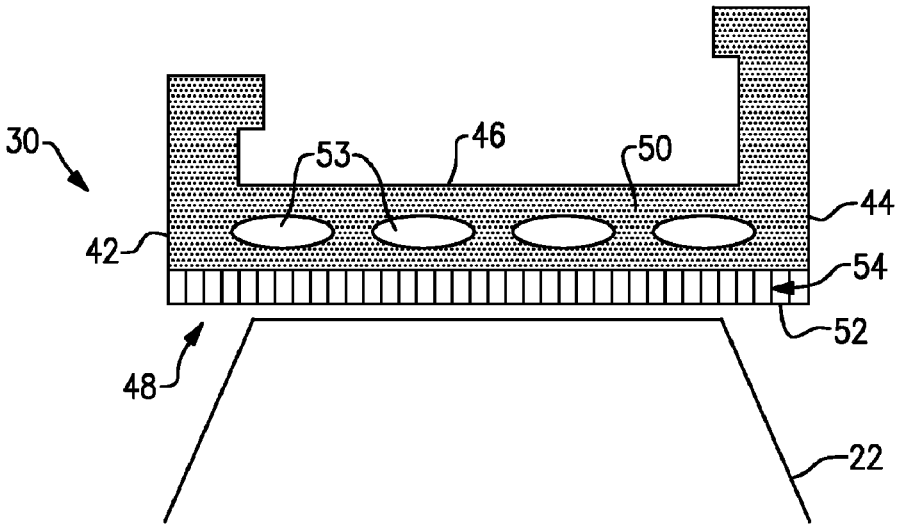
FIG. 3 illustrates an example seal member in the turbine section.

Referring to FIG. 3, the seal member 30 includes a substrate 50, and a gaspath layer 52 bonded to the radially inner side 48 of the substrate 50 and directly exposed to the hot gas flow 26. The gaspath layer 52 may be any thickness that is suitable for the intended use, such as up to 3 mm thick. In some examples, the gaspath layer 52 may have a thickness up to about 1.5 mm. In a further example, the gaspath layer 52 may be up to about 0.5 mm thick, As will be explained below, the gaspath layer 52 facilitates resistance of thermal mechanical fatigue of the seal member 30. Optionally, the seal member 30 may include internal cooling passages 53 for receiving a coolant (e.g., air from the compressor section 16).

The gaspath layer 52 is formed of a metallic alloy and has a columnar microstructure 54 (shown schematically). For instance, the columnar microstructure 54 includes grains that are oriented with a long axis that is approximately perpendicular to the radially inner side 48.

In the operation of a conventional seal member that does not have the gaspath layer 52, the heat of the hot gas flow 26 causes the seal member to thermally expand. The cooler radially outer surface does not expand as much as the radially inner surface that is exposed to the hot gas flow 26. The stiffness of the substrate and geometry of the seal member limit thermal expansion and contraction of the radially inner surface in the axial direction such that the radially inner surface is under compressive stress when temperatures are elevated. The radially inner surface may creep and relax while hot such that the radially inner surface is under tensile stress at cooler temperatures. After repeated cycles of heating and cooling, the stresses may cause deep microcracking at the radially inner surface.

The gaspath layer 52 of the seal member 30 of the disclosed examples facilitates reduction of such thermal mechanical stresses. For instance, thermal expansion of the gaspath layer 52 occurs primarily in the radial direction and is uninhibited in circumferential and axial directions because of the columnar orientation 54. Therefore, the gaspath layer 52 is not subjected to the same limitation in thermal expansion and contraction in the axial direction as in a conventional seal member, and thereby reduces the amount of stress produced from thermal expansion and contraction.

Additionally, any microcracking that may occur in the gaspath layer 52 due to thermal mechanical fatigue would occur in the radial direction, approximately parallel to the long axes of the columnar grains, because of the orientation of the columnar microstructure 54 and thereby relieve at least a portion of the stress. The columnar microstructure 54 thereby may also permit some thermal-mechanical fatigue flexure and uneven thermal expansion of the seal member 30 without generating large stresses that may otherwise cause deep cracks through the substrate 50 in a conventional seal member.

As an example, the use of the gaspath layer 52 having the columnar microstructure 54 to relieve stress allows the substrate 50 and the gaspath layer 52 to be made from materials that are suited for the functions of each. For instance, the substrate 50 in the disclosed example may primarily be a structural component, while the gaspath layer 52 may serve primarily for thermal mechanical fatigue resistance. Therefore, in a design stage, one may select materials suited to each particular function.

In one example, the substrate 50 may be formed from a nickel-based alloy, such as a single crystal nickel alloy. In this regard, the substrate 50 may be comprised of a single crystal of the nickel alloy. The gaspath layer 52 may be formed from the same composition of nickel-based alloy as the substrate 50. However, in other examples, the gaspath layer 52 may be formed of a different alloy, such as a cobalt-based alloy. For instance, the selected alloy may be better suited for forming the columnar microstructure 54, resisting thermal mechanical fatigue, or have other beneficial properties for exposure to the hot gas flow 26. One example cobalt-based alloy includes about 20 wt % of chromium, about 15 wt % of nickel, about 9 wt % of tungsten, about 4.4 wt % of aluminum, about 3 wt % of tantalum, about 1 wt % of hafnium, and a balance of cobalt. It is to be understood however, that other type of heat resistant alloys may be used and that the examples herein are not limited to any particular type of alloy.

Figure 4:
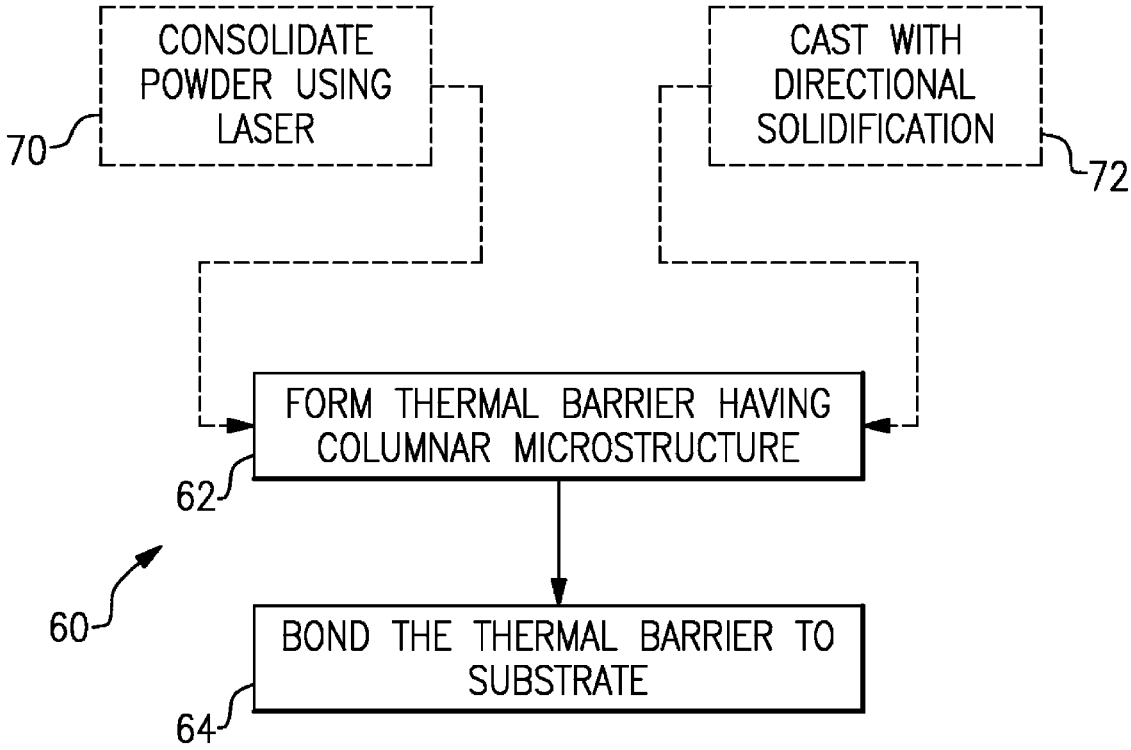
FIG. 4 illustrates an example method of forming the seal member.

FIG. 4 illustrates an example method 60 of manufacturing a gas turbine engine article, such as the seal member 30. In this example, the method 60 includes a step 62 of forming the gaspath layer 52, and a step 64 of bonding the gaspath layer 52 to the substrate 50.

As indicated with the dashed lines, there are various techniques for forming the gaspath layer 52. It is to be understood that there may be additional techniques for forming the gaspath layer 52 that may suit the particular needs of an application.

In one example, forming the gaspath layer 52 includes a step 70 of laser consolidation. In this technique, a powder having a composition that corresponds to the metallic alloy of the gaspath layer 52 is deposited onto the substrate 50 and consolidated in a known manner using a laser. The laser melts the powder and, upon solidification, the metallic alloy directionally solidifies to form the columnar microstructure 54. In this regard, the substrate 50 may be used as a heat sink to remove heat during the laser consolidation process such that the liquid from the melted powder directionally solidifies. The radially outer side 46 may be cooled using water or air to control the cooling rate.

In another example, forming the gaspath layer 52 includes a step 72 of casting a work piece from an alloy composition that corresponds to the metallic alloy selected for the gaspath layer 52. In the casting process the alloy is directionally solidified in a known manner to produce the columnar microstructure 54. The work piece may then be cut or otherwise severed along a plane that is approximately perpendicular to the long axes of the columnar microstructure 54 into a separate piece that is then attached onto the substrate 50. Similarly, the work piece could alternatively be formed by laser consolidating a powder as described above and cut or severed to provide the gaspath layer 52 as a separate piece that is then bonded to the substrate 50.

If the gaspath layer 52 is formed as a separate piece, the gaspath layer 52 may be brazed to the substrate 50. It is to be understood that this disclosure is not limited to brazing and that other techniques for bonding the gaspath layer 52 to the substrate 50 may be used.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A gas turbine engine article comprising:

a substrate extending between two circumferential sides, a leading edge, a trailing edge, an inner side for resisting hot engine exhaust gases, and an outer side; and a gaspath layer bonded to the inner side of the substrate, the gaspath layer comprising a metallic alloy having a columnar microstructure.

2. The gas turbine engine article as recited in claim 1, wherein the substrate comprises another, different metallic alloy than the metallic alloy of the gaspath layer.

3. The gas turbine engine article as recited in claim 2, wherein the metallic alloy of the gaspath layer comprises a cobalt-based alloy and the metallic alloy of the substrate comprises a nickel-based alloy.

4. The gas turbine engine article as recited in claim 1, wherein the metallic alloy comprises a cobalt-based alloy.

5. The gas turbine engine article as recited in claim 1, wherein the metallic alloy comprises about 20 wt % of chromium, about 15 wt % of nickel, about 9 wt % of tungsten, about 4.4 wt % of aluminum, about 3 wt % of tantalum, about 1 wt % of hafnium, and a balance of cobalt.

6. The gas turbine engine article as recited in claim 1, wherein the substrate includes internal cooling passages.

7. The gas turbine engine article as recited in claim 1, wherein the gaspath layer is up to about 3 mm thick.

8. A gas turbine engine comprising:

a compressor section;

a combustor fluidly connected with the compressor section; and a turbine section downstream from the combustor, the turbine section having a seal that includes a substrate extending between two circumferential sides, a leading edge, a trailing edge, an inner side for resisting hot engine exhaust gases from the combustor, and an outer side, and a gaspath layer bonded to the inner side of the substrate, the gaspath layer comprising a metallic alloy having a columnar microstructure.

9. A method of processing a gas turbine engine article, comprising:

forming a gaspath layer comprising a metallic alloy having a columnar microstructure; and bonding the gaspath layer to an inner side of a substrate that extends between two circumferential sides, a leading edge, a trailing edge, the inner side for resisting hot engine exhaust gases, and an outer side.

10. The method as recited in claim 9, further comprising forming the gaspath layer as a separate piece from the substrate and then bonding the separate piece to the inner side of the substrate.

11. The method as recited in claim 9, further comprising forming a work piece of the metallic alloy having the columnar microstructure, and severing the work piece to produce the gaspath layer.

12. The method as recited in claim 11, including severing the work piece along a plane that is approximately perpendicular to the columnar microstructure.

13. The method as recited in claim 11, including forming the work piece using laser consolidation or casting.

14. The method as recited in claim 9, wherein the bonding includes brazing.

15. The method as recited in claim 9, further comprising depositing a powder of the metallic alloy and laser consolidating the powder to form the gaspath layer.

16. The method as recited in claim 15, including controlling heat removal through the substrate during the laser consolidation to form the columnar microstructure.

* * * * *